United States Patent [19]

Funk et al.

[11] 3,999,096

[45] Dec. 21, 1976

[54] LAYERED, MULTI-ELEMENT ELECTRON-BREMSSTRAHLUNG PHOTON CONVERTER TARGET

[75] Inventors: L. Warren Funk; Stanley O. Schriber, both of Deep River, Canada

[73] Assignee: Atomic Energy of Canada Limited, Ottawa, Canada

[22] Filed: Mar. 3, 1975

[21] Appl. No.: 554,564

[30] Foreign Application Priority Data

Dec. 12, 1974 Canada ..... 216311

[52] U.S. Cl. ..... 313/330; 313/55; 313/352; 313/353; 313/311

[51] Int. Cl.[2] ..... H01J 35/08

[58] Field of Search ..... 313/330, 352, 357, 353, 313/311, 346, 55

[56] References Cited

UNITED STATES PATENTS

| | | | |
|---|---|---|---|
| 2,090,636 | 8/1937 | Olshevsky | 313/330 X |
| 2,464,591 | 3/1949 | Larsen et al. | 313/330 X |
| 2,506,327 | 5/1950 | Harrington | 313/330 X |
| 3,662,210 | 5/1972 | Maximov | 313/330 |

*Primary Examiner*—Saxfield Chatmon, Jr.
*Attorney, Agent, or Firm*—Edward Rymek

[57] ABSTRACT

A target for converting kinetic energy of a beam of high energy electrons into bremsstrahlung radiation in the forward direction which consists of a first layer of high or medium Z material that converts the electron energy to bremsstrahlung, a second layer of low Z material that is positioned in the forward direction with respect to the first layer and stops electrons which are transmitted through the first layer, and a third layer of high Z material that is positioned in the forward direction with respect to the second layer and absorbs low-energy photons. The first layer which is of uniform thickness, may be optimized to produce a maximum photon intensity at any desired angle including 0°. The second layer need not be uniform, however has a minimum thickness to stop all electrons. The third layer may be approximately 0.06 g/cm$^2$.

9 Claims, 7 Drawing Figures

LAYERED, MULTI-ELEMENT ELECTRON-BREMSSTRAHLUNG PHOTON CONVERTER TARGET

This invention is related to a target for converting the kinetic energy of a beam of electrons into bremsstrahlung radiation and in particular to a thick multi-layered target for use with high energy electrons to produce bremsstrahlung photons suitable for radio-therapy or radiographic applications.

For radio-therapy in particular it is desired to obtain a spectrum of X-rays or bremsstrahlung which penetrates an object such as a patient, to some controlled depth while minimizing damage to the patient's healthy tissue. The target should therefore produce a beam consisting of an appropriate spectrum of high energy photons with a minimum number of neutrons and electrons.

In prior art devices, high energy electrons such as produced by particle accelerators were used to bombard a target material of high atomic number such as tungsten. The thickness of the target had to be sufficient to halt all of the electrons within the target and this reduced the efficiency of the target since some of the energy was absorbed or scattered within the target.

It is therefore an object of this invention to provide a multi-layered X-ray target.

It is a further object of this invention to provide a multi-layered target for use with a high energy electron beam.

It is another object of this invention to provide a multi-layered target which produces bremsstrahlung photons having as high an average as possible for a given electron energy.

It is a further object of this invention to provide a multi-layered target in which the radiation in the beam is maximized in the forward direction or at some particular angle from the forward direction.

It is another object of this invention to provide a multi-layered target which produces a uniform photon beam over a large solid angle.

It is a further object of this invention to provide a multi-layered target which has a low neutron production.

It is another object of this invention to provide a multi-layered target which will halt all incoming high-energy electrons.

These and other objects are achieved in a target for converting kinetic energy of a beam of electrons into bremsstrahlung radiation in the forward direction which consists of a first layer of high or medium Z material which converts the electron energy to bremsstrahlung, a second layer of low Z material which is positioned in the forward direction with respect to the first layer and stops electrons which are transmitted through the first layer and a third layer of high Z material which is positioned in the forward direction with respect to the second layer and absorbs low energy photons. The first layer which is of uniform thickness, is optimized to produce a maximum photon intensity in the forward direction or at some particular angle from the forward direction. The second layer need not be uniform, however has a minimum thickness to stop all electrons. The third layer may be approximately 0.06 g/cm$^2$.

Figure 3A:
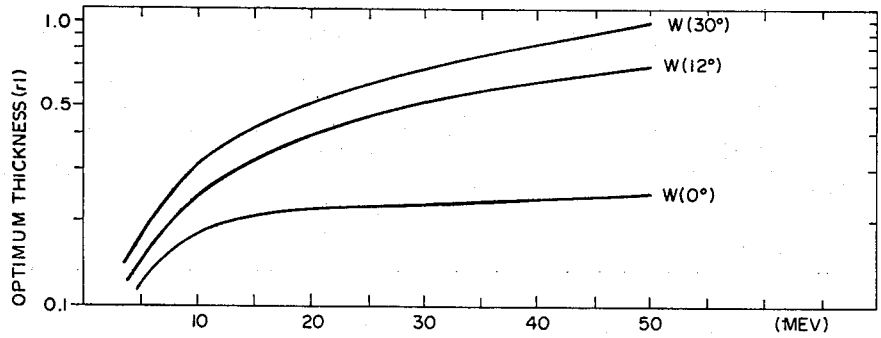
Figure 3B:
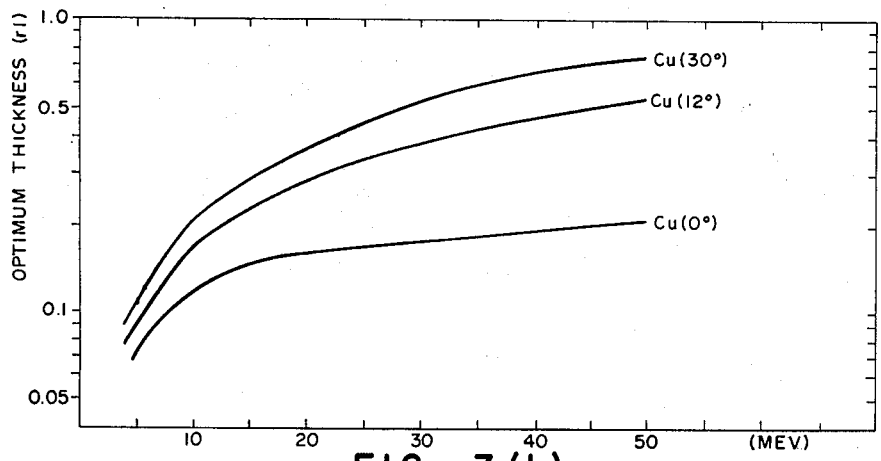
Figure 3C:
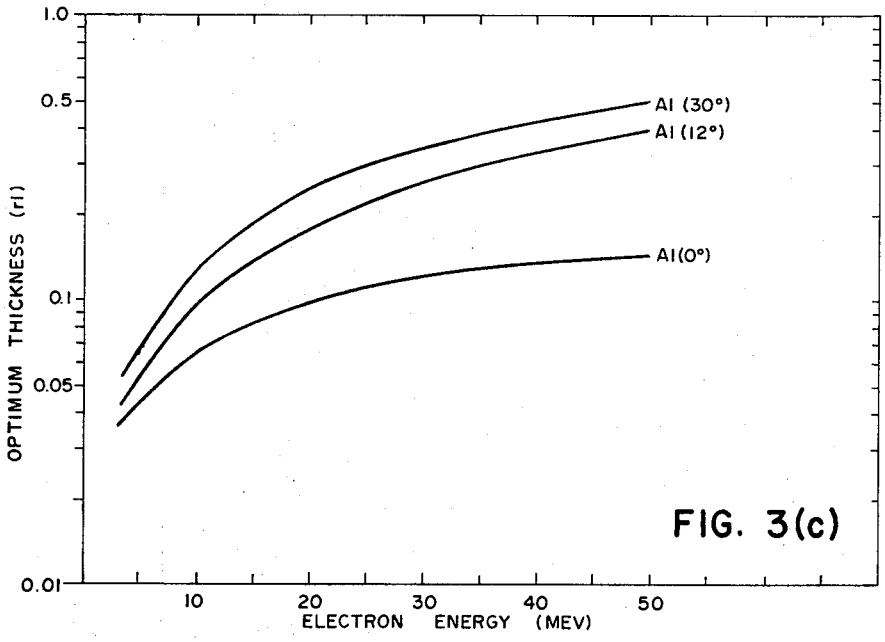
Figure 4:
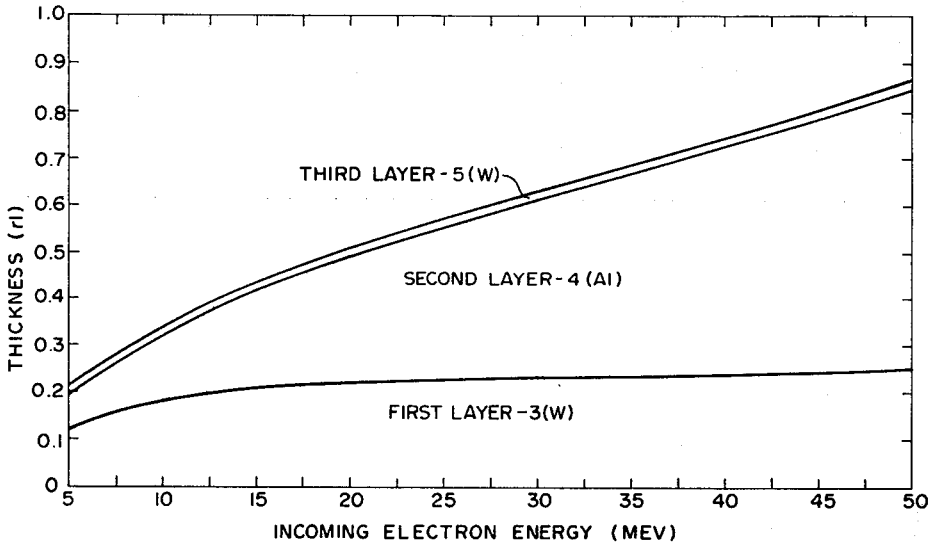
Figure 5:
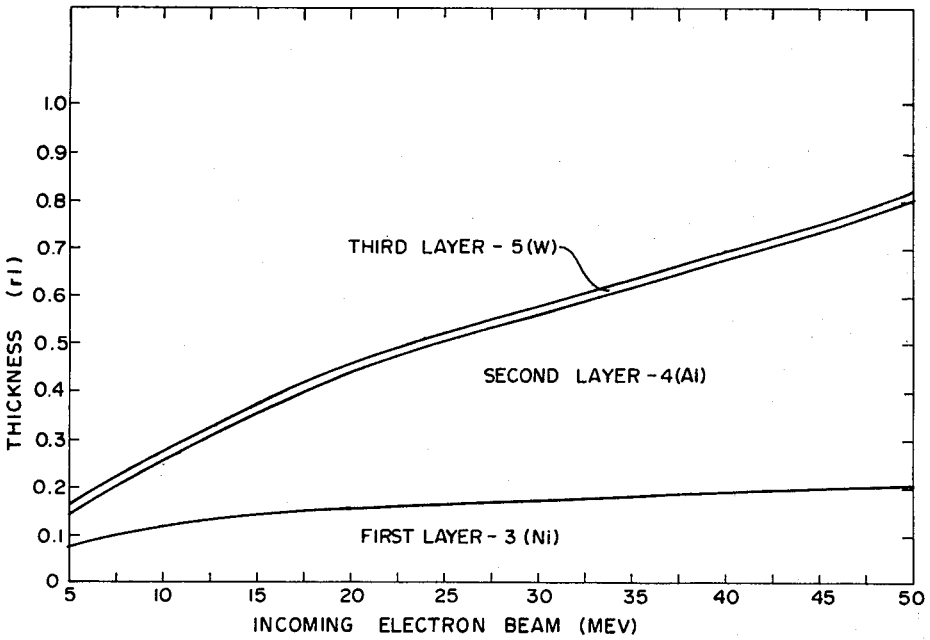

FIGS. 3(a), 3(b) and 3(c) are graphs of optimized thicknesses of tungsten, copper and aluminum respectively versus electron energy for maximized radiation at angles of 0° (the forward direction), 12° and 30°;

FIG. 4 is a graph of layer thickness versus electron energy for a high Z first layer target; and FIG. 5 is a graph of layer thickness versus electron energy for a medium Z first layer target.

Figure 1:
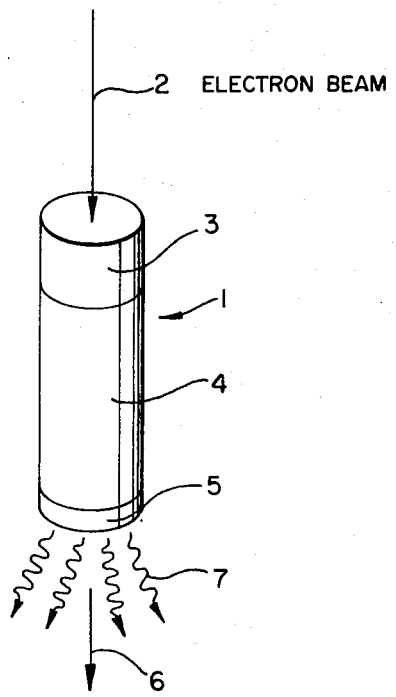
FIG. 1 is a schematic view of the target.

An X-ray target 1 in accordance with this invention is illustrated schematically in FIG. 1 wherein an electron beam 2 is shown entering the target and bremmstrahlung radiation 7 is shown leaving the target. The target 1 consists of three individual layers of material with different atomic numbers. The first layer 3, encountered by the impinging electron beam 2 is normally of uniform thickness and consists of a material of high atomic number Z such as tungsten or gold. High Z materials could be considered as any of those having an atomic number greater than 58. Due to the high Z, a photon beam having a large angular distribution is produced through elastic and inelastic scattering of the electron beam 2. The thickness of layer 3 can be set to produce a maximum amount of radiation in the forward direction, shown by arrow 6, or at some particular angle from the forward direction. All materials have a specific optimum thickness which is a function of the material and the kinetic energy of the electron beam 2.

Figure 2:
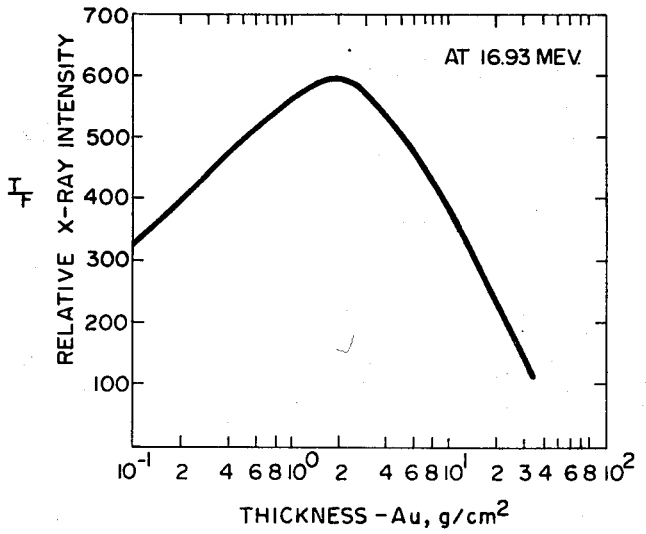
FIG. 2 is a graph of radiation intensity versus thickness for gold.

In the publication "Bremsstrahlung Production and Shielding of Static and Linear Electron Accelerators below 50 MeV Toxic Gas Production, Required Exhaust Rates, and Radiation Protection" by Brynjolfsson and Martin — International Journal of Applied Radiation and Isotopes, 1971, Vol. 22, pages 29–40, it is shown that radiation output in the forward direction is a function of target thickness. This is illustrated in FIG. 2 which is a graph of radiation intensity $I_F$ in the forward direction versus target thickness in g/cm$^2$ for gold. The forward radiation intensity is maximized at one particular optimum thickness $t_{opt}$. As electrons travel through the material, their energy is degraded which results in smaller contribution to the total bremsstrahlung production. In addition, the self-adsorption and scattering of radiation in the material adds to the fall off in intensity for thickness greater than $t_{opt}$. The optimum thickness $t_{opt}$, in radiation lengths for a material may be approximately determined using the equation:

$$t_{opt} = \frac{0.3T}{(a+b\cdot T)\cdot t_z} \qquad (1)$$

where $T$ = initial kinetic energy of the electron in MeV $a$ = stopping power in MeV/g for electronic collisions $b\cdot T$ = stopping power in MeV/g for radiative collisions $t_z$ = radiation length in g/cm$^2$ of a material with atomic number Z At angles other than the forward direction, i,e., angles >0°, radiation output is also a function of target thickness and it has been determined that the optimized thickness for maximum radiation at a particular angle $\theta$ is greater than the optimized thickness for maximum radiation in the forward direction, $\theta$=0°. This is illustrated in FIGS. 3($a$), 3($b$) and 3($c$) which are graphs of optimum thickness versus electron energy for angles of $\theta=0°$, $\theta=12°$ and $\theta=30°$. FIGS. 3(*a*), 3(*b*) and 3(*c*) illustrate optimized material thicknesses for tungsten, copper and aluminum respectively. The optimized thickness of a material for maximum radiation at angles other than those shown may be obtained by interpolation on one or other of the above figures, and the optimized thickness of a material other than those used in the above figures may be approximated by interpolating between points on FIGS. 3(*a*), 3(*b*), and 3(*c*) which represent a high Z, a medium Z and a low Z material respectively.

In order to minimize the production of photo-neutrons, the material used in the first layer 3 may be a medium Z material such as Ni or Cu. Medium Z material could be considered as any of those having an atomic number between 25 and 58. However, a medium Z material results in radiation having a lower forward intensity for the same electron beam power.

The second layer 4 encountered by the electron beam consists of a low Z material, i.e., a material having an atomic number below 25, such as aluminum or aluminum oxide. Layer 4 must have a minimum thickness in order to fully stop the electron beam so that electrons are not transmitted through the target. This thickness is a function of the material used in the layer as well as the kinetic energy of the electron beam as it impinges upon layer 4. A low Z material is required to minimize the attenuation of the photon beam produced in the first layer 3 while stopping the electron beam. Layer 4 further serves as a means of preferentially absorbing low energy bremsstrahlung photons which raises the average energy of the photon beam. The production of photo-neutrons is also reduced by using a low Z material which has a high threshold value and low cross-section for photo-neutron production. In addition, layer 4 need not have a uniform thickness, but may vary in thickness to obtain some desired angular distribution of the photon beam.

The third layer 5 consists of a uniform thin layer of high Z material such as tungsten or gold. Layer 5 preferentially absorbs the low energy photons in the beam in such a manner that the entrance radiation dose in a substance similar to water from the low energy photons, i.e., <1MeV, will not be greater than that from the high energy photons, i.e., >1MeV. This layer would be approximately 0.06 g/cm$^2$ thick, or 0.0094 radiation lengths for tungsten and 0.01 radiation lengths for gold.

As shown on FIG. 1, layer 4 is shown as being immediately adjacent to layer 3 on one side and layer 5 on the other side. For medical instruments, this is usually the case due to the lack of space, however, the layers may be spaced one from the other. In addition, to obtain the smallest target possible in terms of thickness, it is preferred to use high density material for the various layers.

FIGS. 4 and 5 illustrate in graph form, the preferred thicknesses for the three layers used in a target in accordance with this invention as a function of initial electron kinetic energy. The first layer was determined for an optimum thickness related to maximizing the radiation in the forward direction. The thicknesses are expressed in radiation lengths and the targets represented by FIGS. 4 and 5 have a first layer 3 which is a high Z material-tungsten and a medium Z material-nickel respectively. The radiation lengths in g/cm$^2$ for some typical materials are as follows: Al — 26.4, Ni — 13.1, W — 6.37 and Au — 6.02.

The medium Z first layer target illustrated in FIG. 3 will produce a bremsstrahlung strength which is approximately 10% lower than the high Z first layer target, however, photo-neutron strength will be approximately 40% lower at 40 MeV and 80% lower at 25 MeV. The relative strengths of photo-neutron production are shown below in table 1 for fully stopping nickel-aluminum-tungsten, tungsten, and aluminum targets as compared to a tungsten-aluminum-tungsten target.

Table I

| Relative Photoneutron Production | | | | |
|---|---|---|---|---|
| Electron Energy (MeV) | W-Al-W | Ni-Al-W | W | Al |
| 25 | 1 | 0.23 | 6.5 | 0.19 |
| 40 | 1 | 0.61 | 4.6 | 0.49 |

Tables 2 and 3 below show the relative radiation outputs for fully stopping monolayer aluminum and tungsten targets as compared to a tungsten-aluminum-tungsten target at angles of 0° and 12° for the same input beam power.

Table 2

| Electron Energy | W-Al-W | Al | W |
|---|---|---|---|
| (MeV) | $\theta=0°$ | $\theta=0°$ | $\theta=0°$ |
| 50 | 1 | 0.83 | 0.69 |
| 30 | 1 | 0.78 | 0.73 |
| 20 | 1 | 0.74 | 0.76 |
| 10 | 1 | 0.69 | 0.84 |
| 5 | 1 | 0.64 | 0.86 |

Table 3

| Electron Energy | W-Al-W | Al | W |
|---|---|---|---|
| (MeV) | $\theta=12°$ | $\theta=12°$ | $\theta=12°$ |
| 50 | 1 | 0.44 | 0.69 |
| 30 | 1 | 0.48 | 0.73 |
| 20 | 1 | 0.57 | 0.76 |
| 10 | 1 | 0.55 | 0.84 |
| 5 | 1 | 0.47 | 0.86 |

We claim:

1. A target for converting the kinetic energy of a beam of electrons into bremsstrahlung radiation primarily in the beam forward direction comprising:

a first layer of material upon which the electron beam is to be directed, said first layer consisting of a high Z material having an atomic number Z greater than 58 or a medium Z material having an atomic number Z greater than 25 and less than 58, for converting said electron energy to bremsstrahlung radiation;

a second layer of material positioned in the beam forward direction with respect to said first layer, said second layer consisting of a low Z material having an atomic number Z less than 25, for stopping electrons transmitted through said first layer; and a third layer of material positioned in the beam forward direction with respect to said second layer, said third layer consisting of a high Z material for absorbing low energy photons in the bremsstrahlung radiation.

2. A target as claimed in claim 1 wherein said first layer is of uniform thickness $t_{opt}$ for maximum radiation in the forward direction wherein:

$$t_{opt} = \frac{0.3T}{(a+b\cdot T)\cdot t_z}$$

where $T$ = initial kinetic energy of the electron in MeV $a$ = stopping power in MeV/g for electronic collisions $b\cdot T$ = stopping power in MeV/g for radiative collisions $t_z$ = radiation length in g/cm$^2$ of a material with atomic number Z.

3. A target as claimed in claim 1 wherein said first layer is of uniform thickness greater than $t_{opt}$ for maximum radiation at a predetermined angle from the forward direction wherein:

$$t_{opt} = \frac{0.3T}{(a+b\cdot T)\cdot t_z}$$

where $T$ = initial kinetic energy of the electron in MeV $a$ = stopping power in MeV/g for electronic collisions $b\cdot T$ = stopping power in MeV/g for radiative collisions $t_z$ = radiation length in g/cm$^2$ of a material with atomic number Z.

4. A target as claimed in claim 2 wherein said second layer is of minimum thickness for stopping all of the electrons transmitted through said first layer.

5. A target as claimed in claim 4 wherein said third layer is of uniform thickness of approximately 0.06 g/cm$^2$.

6. A target as claimed in claim 1 wherein said first, second and third layers consist of high density materials.

7. A target as claimed in claim 1 wherein said second layer is positioned adjacent to said first layer and said third layer is positioned adjacent to second layer.

8. A target as claimed in claim 1 wherein said high Z material is tungsten or gold, and said low Z material is aluminum or aluminum oxide.

9. A target as claimed in claim 8 wherein said medium Z material is nickel or copper.

* * * * *